US007182680B2

(12) United States Patent
Butterfield et al.

(10) Patent No.: US 7,182,680 B2
(45) Date of Patent: Feb. 27, 2007

(54) APPARATUS FOR CONDITIONING PROCESSING PADS

(75) Inventors: Paul D. Butterfield, San Jose, CA (US); Sen-Hou Ko, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/102,052

(22) Filed: Apr. 8, 2005

(65) Prior Publication Data

US 2005/0282477 A1 Dec. 22, 2005

Related U.S. Application Data

(60) Provisional application No. 60/582,239, filed on Jun. 22, 2004.

(51) Int. Cl.
*B24B 53/00* (2006.01)

(52) U.S. Cl. ..... 451/443; 451/56

(58) Field of Classification Search ..... 451/21, 451/443, 444, 56, 5, 72
See application file for complete search history.

(56) References Cited

U.S. PATENT DOCUMENTS 5,081,051 A 1/1992 Mattingly et al.
5,785,585 A 7/1998 Manfredi et al.
5,885,137 A * 3/1999 Ploessl ..... 451/56
5,885,147 A * 3/1999 Kreager et al. ..... 451/443
5,938,507 A 8/1999 Ko et al.
6,244,935 B1 6/2001 Birang et al.
6,273,797 B1 8/2001 Becker et al.
6,325,709 B1 * 12/2001 Nanda et al. ..... 451/443
6,572,446 B1 6/2003 Osterheld et al.
6,648,731 B2 * 11/2003 Shin ..... 451/24
6,767,427 B2 * 7/2004 Walters et al. ..... 156/345.12
6,935,938 B1 * 8/2005 Gotkis et al. ..... 451/443
7,004,825 B1 * 2/2006 Taylor et al. ..... 451/72

* cited by examiner

*Primary Examiner*—Robert A. Rose
(74) *Attorney, Agent, or Firm*—Patterson and Sheridan

(57) ABSTRACT

Embodiments of a flexible pad conditioner for conditioning a processing pad are provided. The pad conditioner includes an arc-shaped member having an abrasive bottom surface configured for conditioning the processing pad. Means are provided to apply a downward force as well as to oscillate the pad conditioner. Further means may be provided to vary the downward force along the length of the pad conditioner. In one embodiment, a plurality of actuators may be coupled to a top surface of the member and adapted to selectively provide an independently controllable force against the member to finely control the conditioning profile.

1 Claim, 6 Drawing Sheets

APPARATUS FOR CONDITIONING PROCESSING PADS

CROSS-REFERENCE TO RELATED APPLICATION

This application claims benefit of U.S. Provisional Patent Application Ser. No. 60/582,239, filed Jun. 22, 2004, which is hereby incorporated by reference in its entirety.

BACKGROUND OF THE INVENTION

1. Field of the Invention

Embodiments of the invention generally relate to processing pad conditioning apparatus.

2. Description of the Related Art

Chemical Mechanical Polishing (CMP) is a technique used to remove materials from a substrate surface in part by chemical dissolution while concurrently polishing the substrate. Chemical dissolution is performed by applying a reactive chemical slurry to a substrate surface to remove conductive materials from the substrate surface. The slurry may be applied to the substrate surface by contact with a polishing material upon which the substrate is processed. In one embodiment, the polishing material may be a polishing pad disposed on a platen. A mechanical component of the polishing process is performed by providing relative motion between the substrate and the polishing material. The mechanical component of the process enhances the rate at which the conductive material is removed from the substrate.

Over time, the effectiveness of the polishing pad diminishes as pressure, friction, and heat combine with particulate matter from processing slurries, materials removed from the substrate (or from the pad itself), and the like, to form a hard, relatively smooth surface on the pad. This effect is typically called "glazing."

In order to improve the effectiveness of the polishing pad after glazing has occurred, the polishing pad may be periodically conditioned. One conventional pad conditioner, described in U.S. Pat. No. 5,081,051, entitled, "Method For Conditioning The Surface Of A Polishing Pad," utilizes a rigid, serrated blade to roughen the surface of the polishing pad. Another conventional pad conditioner, described in U.S. Pat. Nos. 5,785,585 and 6,273,797, respectively entitled, "Polish Pad Conditioner With Radial Compensation," and "In-situ Automated CMP Wedge Conditioner," utilizes a serrated wedge loosely contained in a holder. Although the pad conditioners described in these patents allow for some movement of the conditioning elements, the serrated blade and serrated wedge themselves are rigid and inflexible. This inflexibility hampers the ability of the conditioner to provide local control over the polishing profile.

Therefore, there is a need for an improved polishing pad conditioner with improved flexibility and control over the local polishing profile of the polishing pad.

SUMMARY OF THE INVENTION

In one embodiment, a flexible pad conditioner for conditioning a processing pad includes a flexible conditioning strip secured to a holder. The holder has a wedge shape to orient the conditioning strip at an angle to the pad to be conditioned. The conditioning strip has abrasive elements bonded to its surface and includes numerous independent fingers which contact the surface of the pad. An actuator is provided to apply a downward force. Another actuator may also oscillate the pad conditioner. The profile of downward force along the length of the pad conditioner may be varied.

In another embodiment, the flexible pad conditioner includes a plurality of conditioning fingers secured to a holder by a parallel suspension system. The parallel suspension system maintains the conditioning fingers substantially parallel to the pad to be conditioned. The conditioning fingers have abrasive elements bonded to a lower conditioning surface which contacts the surface of the pad. An actuator is provided to apply a downward force. Another actuator may also oscillate the pad conditioner. The profile of downward force along the length of the pad conditioner may optionally be varied.

In another embodiment, the pad conditioner includes an arc-shaped member having an abrasive bottom surface configured for conditioning the processing pad. A mechanism is provided to apply a downward force as well as to oscillate the pad conditioner. Further mechanisms may be provided to vary the downward force along the length of the pad conditioner. In one embodiment, a plurality of actuators may be coupled to a top surface of the member and adapted to selectively provide an independently controllable force against the member to finely control the conditioning profile.

In another embodiment, the pad conditioner includes a conditioning element having an abrasive bottom surface and a support coupled to the conditioning element. A plurality of actuators are disposed between the conditioning element and the support. The actuators are configured to selectively and apply an independently controllable force that contours the bottom surface of the conditioning element.

In another aspect of the invention, a method for conditioning a processing pad is provided. In one embodiment, the method includes the steps of providing a pad conditioner comprising an arc-shaped member having an abrasive bottom surface configured for conditioning a processing pad and pressing the member with a first force against the processing pad while rotating the pad. One or more of a plurality of actuators may be actuated to control the processing profile of the processing pad. The actuators are independently able to apply an adjustable force that modifies the processing profile developed in the surface of the pad by operation of the pad conditioner.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

An apparatus and methods for conditioning a processing pad are provided herein. As discussed below, the apparatus provides increased pad conditioning flexibility, as compared to prior art pad conditioners. The pad conditioner increases the degree of control over the polishing pad profile. The apparatus also improves substrate processing performance during in-situ pad conditioning processes by continuously providing freshly conditioned pad surfaces for substrate processing. Although the description below is with reference to a CMP polishing system, it is contemplated that the teachings disclosed herein may be used to condition processing pads in other polishing systems as well.

Figure 1:
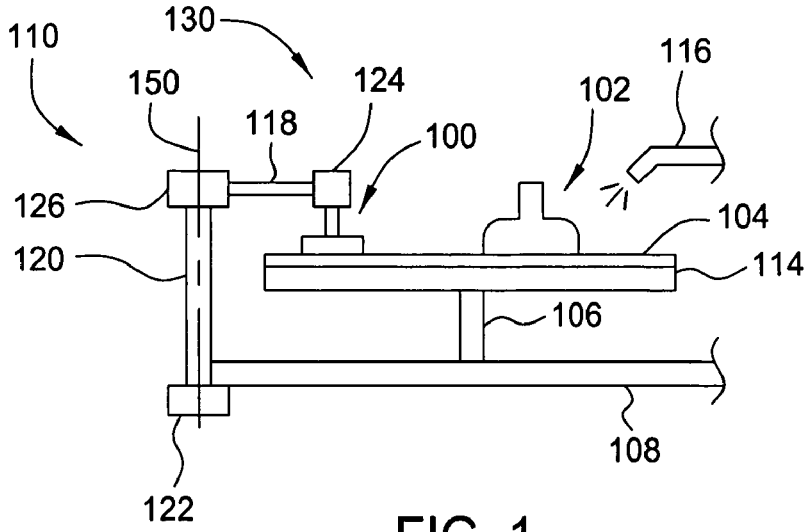
FIG. 1 is a simplified side view of a CMP polishing station having a pad conditioner of the present invention.

FIG. 1 is a simplified side view of a polishing station 130 of a CMP system having one embodiment of a pad conditioner 100. Examples of polishing stations 130 that can be adapted to benefit from the invention include MIRRA®, MIRRA MESA™ and REFLEXION® Chemical Mechanical Polishing Systems, all available from Applied Materials, Inc. of Santa Clara, Calif. Further examples of polishing stations that may be adapted to benefit from the invention are described in U.S. Pat. No. 6,244,935 issued Jun. 12, 2001, to Birang et al., entitled, "Apparatus and Methods for Chemical Mechanical Polishing with an Advanceable Polishing Sheet," and U.S. patent application Ser. No. 10/880,752 filed Jun. 30, 2004 by Wang, et al., entitled, "Method and Apparatus for Electrochemical Mechanical Processing," both of which are incorporated herein by reference in their entireties. Other polishing modules, including those that use polishing pads, polishing webs, or a combination thereof, may also be adapted to benefit from the invention.

The polishing station 130 generally includes a platen 114 supported by a shaft 106 disposed on or through a base 108. The platen 114 may be rotated by a motor (not shown). A polishing pad 104 is disposed on the upper surface of the platen 114. Examples of polishing and other processing pads suitable for use in a polishing system are described in U.S. patent application Ser. No. 10/455,895, filed Jun. 30, 2003, entitled, "Conductive Polishing Article for Electrochemical Mechanical Polishing," and U.S. patent application Ser. No. 10/642,128, filed Aug. 15, 2003, entitled, "Conductive Polishing Article for Electrochemical Mechanical Polishing," each of which are hereby incorporated by reference in their entireties.

A carrier head 102 is disposed above the platen 114 and is adapted to hold a substrate to be processed against the polishing pad 104. The carrier head 102 may also impart a relative motion between the substrate and the polishing pad 104. In one embodiment, the carrier head 102 may be a TITAN HEAD™ or TITAN PROFILER™ wafer carrier manufactured by Applied Materials, Inc., of Santa Clara, Calif. A processing fluid, such as an abrasive slurry, may be provided to the surface of the polishing pad 104 by, for example, a nozzle 116 coupled to a processing fluid source (not shown). Alternatively, the polishing fluid may be provided through the platen 114 and polishing pad 104.

The pad conditioner 100 is supported by a support assembly 110 coupled to the base 108. Support assembly 110 is adapted to position the pad conditioner 100 in contact with the polishing pad 104 and may further be adapted to provide a relative motion therebetween. The pad conditioner 100 oscillates radially across the surface of the polishing pad 104 as indicated by arrows 310 in FIG. 3. The oscillating motion of the pad conditioner 100 is generally in a range of from about the center of the polishing pad 104 to about the outer edge of the polishing pad 104, such that, in combination with the rotation of the polishing pad 104, the entire surface of the polishing pad 104 may be conditioned. The pad conditioner 100 may also be rotated to move the pad conditioner 100 beyond the edge of the polishing pad 104, e.g., when not in use (as shown in phantom in FIG. 3). One example of a support assembly that may be modified to use with the pad conditioner 100 is described in U.S. Pat. No. 6,702,651, issued Mar. 9, 2004, to Tolles, et al., entitled, "Method and Apparatus for Conditioning a Polishing Pad," which is hereby incorporated by reference.

In one embodiment, the support assembly 110 includes a stanchion 120 coupled to the base 108 and a support arm 118 coupled to the stanchion 120. The support arm 118 cantilevers the pad conditioner 100 over the polishing pad 104. An actuator 122 may be used to rotate the support arm 118, and hence, the pad conditioner 100, relative to an axis 150 in order to position the pad conditioner 100 over the polishing pad 104 or to the side of the polishing pad 104 when not in use.

One or more actuators 124 (one shown in FIG. 1) may raise and lower the pad conditioner 100 relative to the polishing pad 104 such that the pad conditioner 100 may be selectively in or out of contact with the polishing pad 104. The actuators 124 are generally configured to press the pad conditioner 100 against the polishing pad 104 with a downward force in the range of from about 0.1 to about 10 pounds per square inch (psi). The downward force may also be varied along the length of the pad conditioner 100 such that the pad conditioner 100 exerts a greater force to one region of the polishing pad 104 and a lesser force to a different region of the polishing pad 104. For example, multiple actuators 124 may be coupled to different positions along the length of the pad conditioner 100. The multiple actuators 124 may be independently controlled to press the pad conditioner 100 against the polishing pad 104 with different forces. Alternatively, a single actuator 124 may be used to apply an off-center force to the pad conditioner 100.

Figure 3:
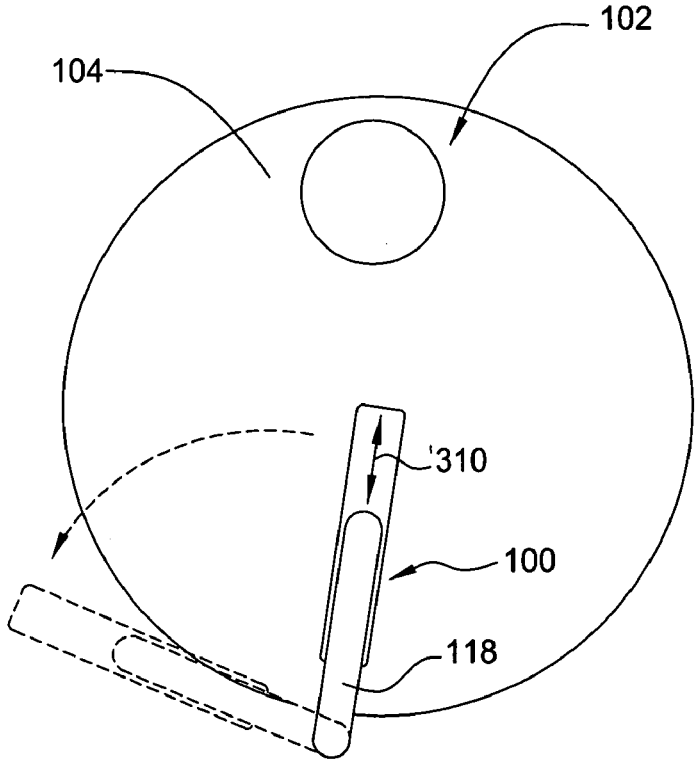
FIG. 3 is a plan view of one configuration of a pad conditioner and a polishing head atop a polishing pad.

The pad conditioner 100 is generally oriented radially with respect to the center of the polishing pad 104 when in use (as shown in FIG. 3). An actuator 126 may be used to oscillate the pad conditioner 100 radially while in contact with the polishing pad 104, as depicted by arrows 310 in FIG. 3. The pad conditioner generally has a range of radial motion of about 1 to about 2 inches and oscillates at a frequency in the range of from about 0.1 to about 10 Hz.

Figure 2A:
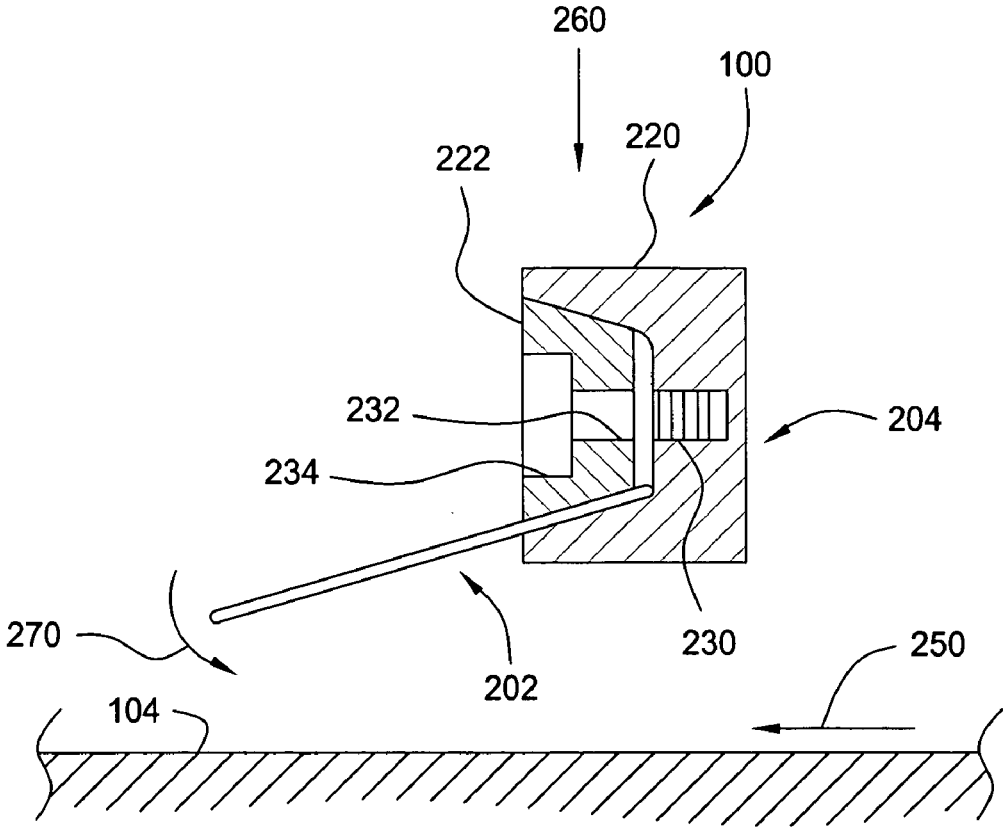
FIGS. 2A–2B respectively depict a sectional side view and a top view of one embodiment of a pad conditioner.
Figure 2B:
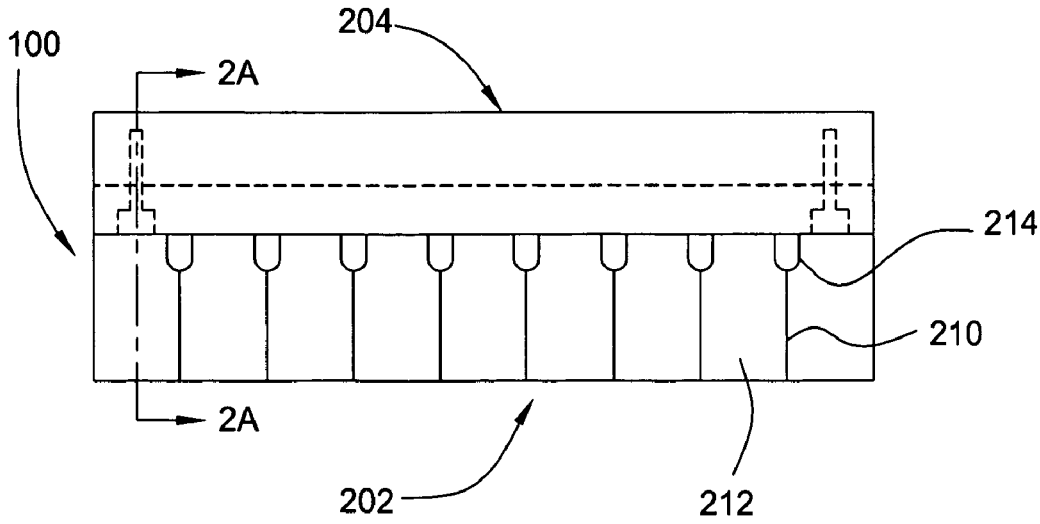

FIGS. 2A and 2B respectively show sectional side and top views of one embodiment of a pad conditioner 100. Referring to FIG. 2A, the conditioner 100 generally includes a conditioning strip 202 retained in a holder 204. The holder 204 includes a body 220 and a wedge 222. The conditioning strip 202 is held in place in the holder 204 by the wedge 222. The wedge 222 is fastened into the body 220 via one or more fasteners, such as a bolt, that passes through a hole 232 formed in the wedge 222 and into a threaded hole 230 formed in the body 220. A counterbore 234 is provided such that the head of the bolt is flush with or below the surface of the wedge 222. Although only two fasteners are shown in phantom in FIG. 2B, it is contemplated that multiple fasteners may be used to secure the conditioning strip 202 in the holder 204. The wedge 222 and the plurality of fasteners ensure that no part of the conditioning strip 202 will be able to inadvertently move or slip out of the holder 204 and provides more precise control over the forces applied by the conditioning strip 202 to the polishing pad 104. The angled shape of the wedge 222 and body 220 orient the conditioning strip 202 at an angle desirable for conditioning the polishing pad 104.

The conditioner 100 may be configured to move in one or more directions in order to apply a force against the polishing pad 104. When positioned over the polishing pad 104, which is moving towards the left as indicated by arrow 250, the conditioner 100 may apply a direct downward force as indicated by arrow 260. Alternatively, or in combination, a rotational force, as indicated by arrow 270, may be applied to the conditioner 100 to control the contact between the conditioning strip 202 and the polishing pad 104.

As shown in FIG. 2B, the conditioning strip 202 is generally separated into multiple fingers 212 by corresponding slots 210 cut into the conditioning strip 202. The number of fingers 212 in the conditioning strip 202 may be varied by making the fingers 212 wider or narrower and the fingers 212 may be the same or of varying widths, depending on the desired conditioning profile. For example wider fingers 212 provide less flexibility as compared to narrower fingers 212. As such, the polishing profile may be controlled by the use and arrangement of wider and narrower fingers 212 arranged as desired to apply greater or lesser force against the polishing pad 104.

The slots 210 generally extend at least to the edge of the holder 204 and may optionally include a clearance hole 214 formed near the intersection of the conditioning strip 202 with the holder 204. The length of the slots 210 and optional clearance hole 214 ensures freedom of movement of each of the fingers 212 and prevents distortion of the conditioning strip 202 when it is tightly fastened to the holder 204. The slots 210 also enable polishing or other fluids to move between the fingers 212 during conditioning. Alternatively, each of the fingers 212 could be independent units held together in the holder 204.

The conditioning strip 202 is typically made of a corrosion-resistant material, such as stainless steel or beryllium copper. Abrasive conditioning elements are bonded to the surface of the conditioning strip 202 facing the polishing pad 104. The abrasiveness of the conditioning elements may be selected depending upon the requirements of a particular conditioning process. For example, a delicate pad may require a less abrasive conditioning element, while a more robust pad can tolerate, and may require, conditioning elements that are more abrasive. Examples of suitable abrasives include diamond, ceramic, metallic particles, and the like. In one embodiment, the abrasive conditioning elements may range in size from 60 to about 300 μm. In one embodiment, the abrasive conditioning elements may have a MOHS hardness of about 10 to about 15. It is contemplated that the abrasive material, size, hardness, and distribution on the conditioning strip 202 may be selected as desired for particular conditioning processes.

Alternatively, the abrasive conditioning elements may be an integral part of and formed directly on the conditioning strip 202. For example, raised teeth, ridges, grooves, and the like may be cut or otherwise formed into the conditioning strip 202. The abrasive conditioning elements formed in this fashion may be formed in a pattern as required to provide the desired abrasive quality to the conditioning strip 202.

Figure 4:
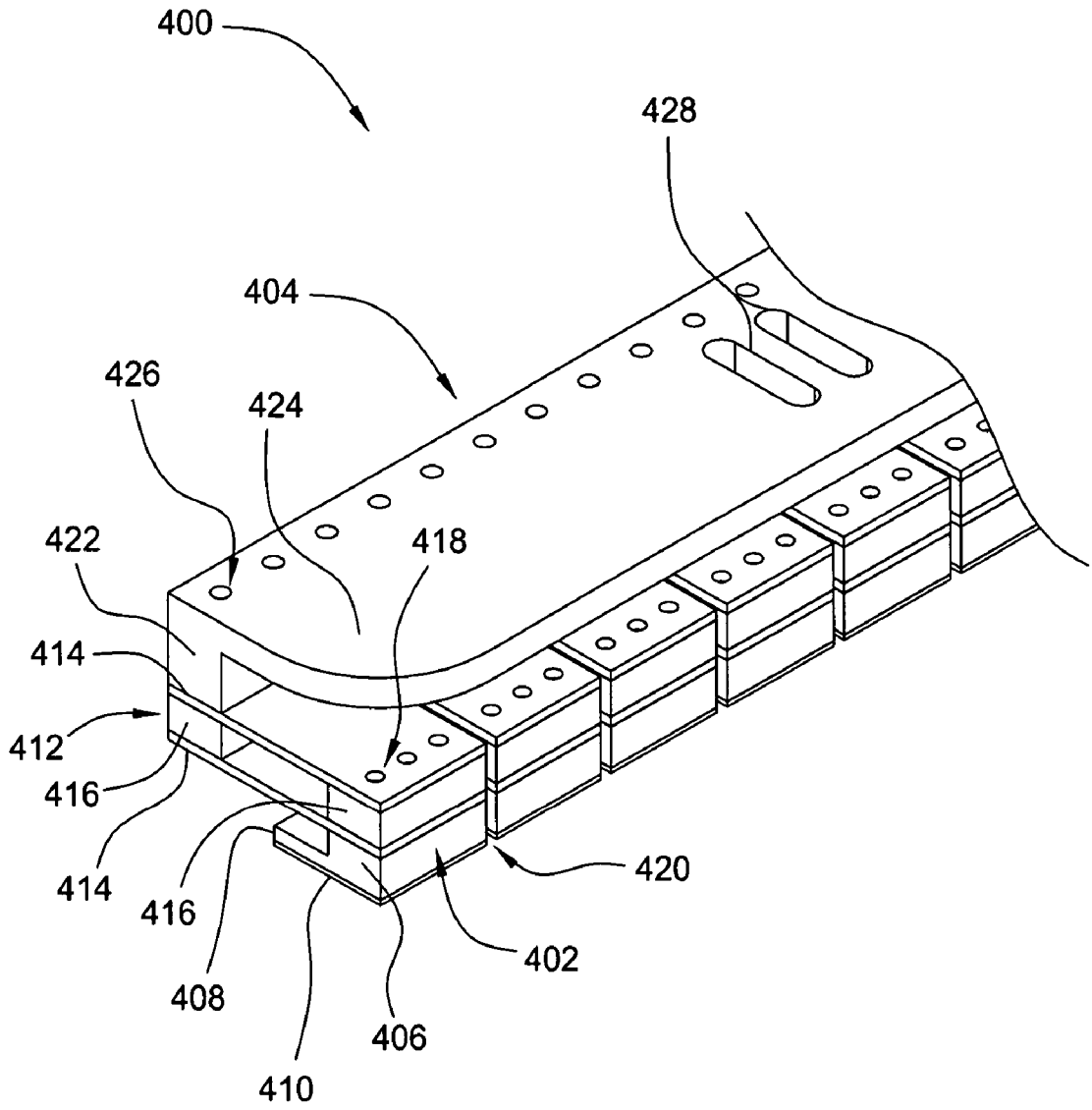
FIG. 4 is a partial isometric view of another embodiment of a pad conditioner.

FIG. 4 depicts another embodiment of a polishing pad conditioner 400. In this embodiment, a pad conditioner 400 includes a holder 404 coupled to a plurality of conditioning elements 402 by a parallel suspension system 412. The holder 404 consists of a main body 422 and an upper extension 424. A plurality of holes 426 are formed through the body 422 for fastening the parallel suspension system 412 to the holder 404. Alternatively, the holder may be coupled to the parallel suspension system 412 by, for example, bonding, welding, and the like. A hole 428, shown as a pair of holes 428 in FIG. 4, may be provided to couple the holder 404 to the support arm 118 of the support assembly 110. However, it is contemplated that the holder 404 may be coupled to the support arm 118 by any conventional means.

The holder 404 is generally rigid in order to uniformly transfer the force applied from the actuator 124 (depicted in FIG. 1) to the individual conditioning elements 402. The holder 404 may transfer the force applied by the actuator 124 uniformly, and symmetrically to the conditioning elements 402, for example, by applying the force to the center of the holder 404. Alternatively, the holder 404 may transfer the force in an off-set manner, for example, by applying the force to the holder 404 off-set from the center of the holder 404. In another embodiment, two actuators 124 may be used to provide a force gradient that is not uniform from one end of the pad conditioner 400 to the other. In yet another embodiment, the holder 404 may be flexible, rather than rigid, and two or more actuators 124 may be used to create a non-linear force gradient along the pad conditioner 400 to further control the resultant polishing profile of a conditioned polishing pad. Although the above teachings are described with respect to the embodiment depicted in FIG. 4, these teachings are equally applicable to the embodiment depicted in FIG. 2, as well as other embodiments incorporating the teachings described herein.

Each of the plurality of conditioning elements 402 has a main body 406 having a lower extension 408. The bottom surface of the conditioning element 402 defines a conditioning surface 410. The conditioning surface 410 is generally held substantially parallel to the surface of the polishing pad by the parallel suspension system 412. The width and contact length of each of the conditioning elements 402 may be selected to optimize a particular conditioning application. In addition, the width and contact length of each of the conditioning elements 402 need not be identical and may be varied to further control the resultant polishing profile of a conditioned polishing pad. The plurality of conditioning elements 402 are generally spaced close to each other and may abut or come into contact with each other. Alternatively, a gap 420 may be provided between each of the conditioning elements 402 to ensure that each individual conditioning element 402 may move freely and is independent of the other conditioning elements 402. In addition, although the sides of each conditioning element 402 are shown as being straight in FIG. 4, it is contemplated that the sides of the conditioning elements 402 may be curved, wavy, slanted, or otherwise interlocking (rather than straight) to further enhance uniformity of conditioning and to avoid having unconditioned strips or areas on the pad which may adversely affect processing of the substrate.

The conditioning surface 410 is generally an abrasive surface adapted to condition the polishing pad. Abrasives may include diamond, ceramic, or metallic particles, and the like, embedded in or bonded to a base material. In one embodiment, the conditioning surface 410 may be a separate material that is bonded or adhered to the lower extension 408. For example, an adhesive-backed abrasive pad may be attached to the lower extension 408 to form the conditioning surface 410. In another embodiment, the conditioning surface 410 may be a molded part of the lower extension 408 of the conditioning element 402. For example, the conditioning element 402 may comprise a molded polyurethane part having abrasive elements embedded therein and exposed along the lower extension 408 to form the conditioning surface 410. Alternatively, the conditioning surface 410 may comprise a patterned surface of the lower extension 408 of the conditioning element 402. The patterned surface may have raised teeth, ridges, or grooves, and the like, formed directly thereon to form the conditioning surface 410.

The parallel suspension system 412 includes a pair of springs 414 spaced apart by a pair of spacers 416. The springs 414 are generally made of a corrosion-resistant material, such as stainless steel or beryllium copper. Alternatively, springs 414 may be made of a polymer or other material compatible with the process chemistries and having the desired physical properties to perform the function of the springs 414. The springs 414 are adapted to allow deflection of the conditioning elements 402 while maintaining the alignment of the conditioning elements 402 with respect to the polishing pad and with respect to any neighboring conditioning elements 402. Although each pair of springs 414 shown in FIG. 4 are identical, it is contemplated that any spring 414, whether individually or as part of a pair, may be fabricated from different materials, have different dimensions, or otherwise have different physical properties in order to further control the deflection of, and downward force applied to, each of the corresponding conditioning elements 402 coupled to the parallel suspension system 412. It is also contemplated that a single layer flexible strip may be utilized in place of the parallel suspension system 412.

A plurality of holes 418 are generally provided on both ends of the parallel suspension system 412 for coupling the parallel suspension system 412 to the plurality of conditioning elements 402 and to the holder 404. (The plurality of holes 418 are only shown above the conditioning elements 402 in FIG. 4.) Alternatively, other methods for coupling the components may be utilized and may include, for example, gluing, bonding, welding, and the like, or any combination thereof.

In another embodiment, a plurality of mini-actuators (not shown) may be utilized in conjunction with the parallel suspension system 412 in order to further control the force applied by each of the conditioning elements 402 to the polishing pad. Examples of such mini-actuators may include vacuum, air, or hydraulic cylinders, motors, solenoids, and the like. Optionally, anti-rotation gimbals (not shown) may also be coupled to parallel suspension system 412 and act near the centroid of each conditioning element 402 to reduce rotational deflection of the conditioning element 402 and maintain near parallel orientation with the polishing pad 104.

Figure 5A:
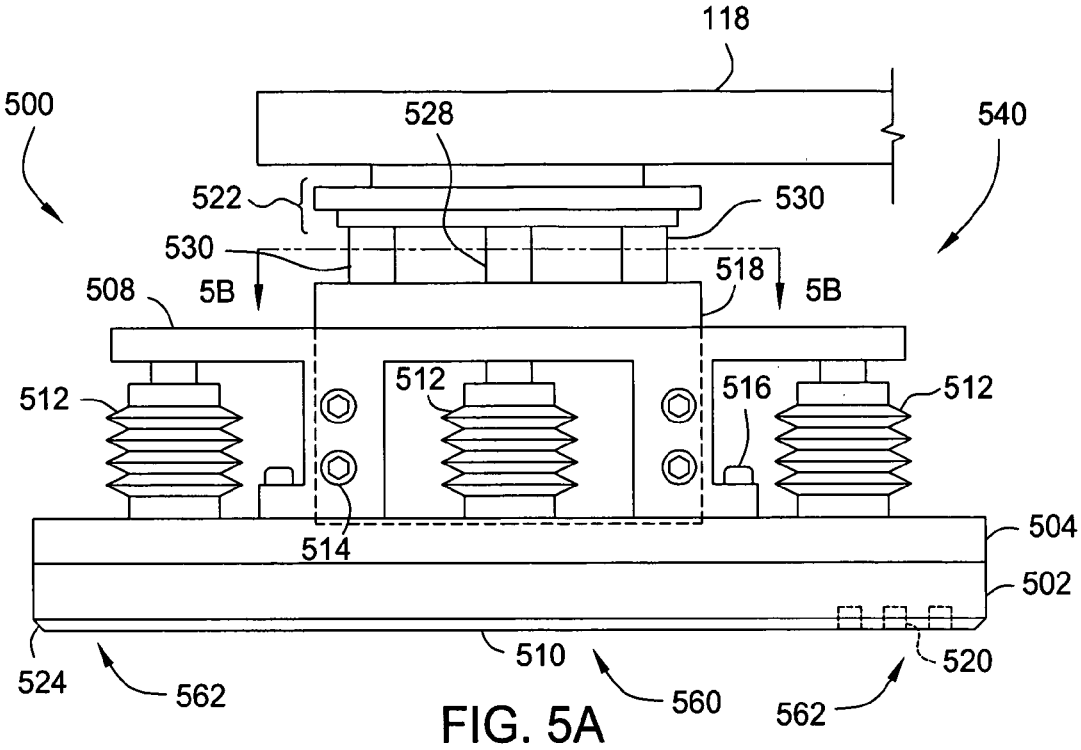
FIGS. 5A–5B respectively depict front and top views of another embodiment of a pad conditioner.
Figure 5B:
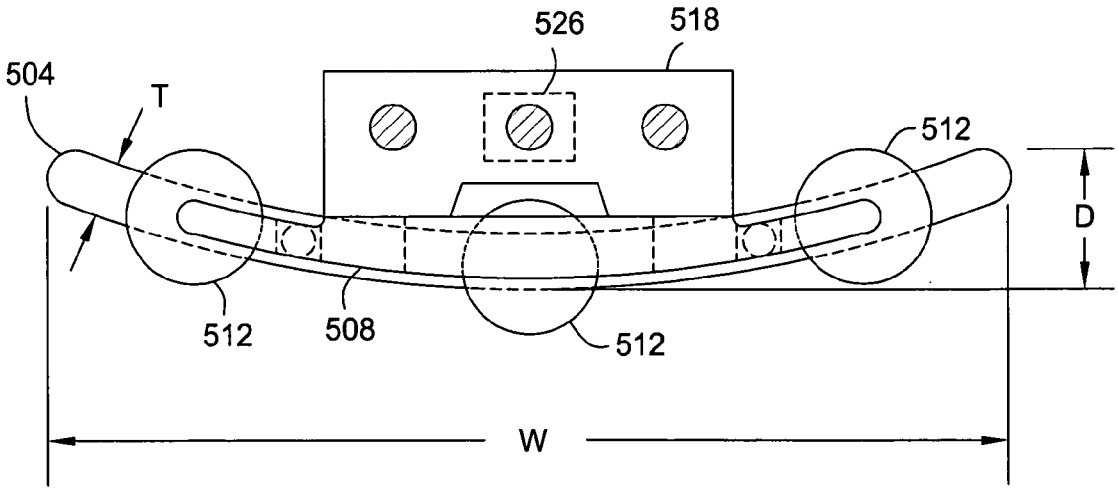

Another embodiment of a polishing pad conditioner is depicted in FIGS. 5A and 5B, which respectively show a front and a top view of a polishing pad conditioner 500. The polishing pad conditioner 500 includes a conditioning element 502 coupled to a housing 540. The housing 540 is coupled to the support arm 118 to minimize the possibility of any distortion of the conditioning element 502 that could result in a distortion of the conditioning force being applied to the polishing pad 104.

In one embodiment, the conditioning element 502 is generally arcuate, or arc-shaped. As used herein, arc-shaped includes sections of circles, ellipses, involute curves, spirals, and other shapes having a concave or convex form. The arcuate shape of the conditioning element 502 provides greater flexibility in creating controlled polishing profiles in a polishing pad being conditioned. The arcuate shape of the pad conditioning element further assists in maintaining stability of the pad conditioner 500, thereby reducing chattering (i.e., the rapid, catching and releasing of the polishing pad by the conditioning element 502) and increasing conditioning uniformity. The arcuate shape of the pad conditioning element 502 provides further flexibility and control over the conditioning forces applied as compared to linear, wedge-shaped, circular, or elliptical conditioning elements.

The curve of the arc-shaped conditioning element 502 is typically sufficient to allow the polishing pad conditioner 500 to be brought into contact with a rotating polishing pad while remaining stable, e.g., without bending, distorting, or chattering. The curve of the conditioning element 502 generally has a width W and a depth D suitable for a particular process. The actual width W and depth D required for a particular process depends upon the friction developing between the conditioning element 502 and the processing pad, speeds of rotation, downward forces being applied, and the like. In one embodiment, the conditioning element 502 has a depth D of between 2 and 4 inches for use with a 15 inch radius polishing pad. The conditioning element 502 typically has a thickness T of between about 0.1 to about 1 inch.

The conditioning element 502 is generally formed from a corrosion resistant material suitable for the process chemistries and environment. The conditioning element 502 is further suitable for plating or bonding abrasive elements thereto. In one embodiment, the conditioning element 502 is made of stainless steel. A bottom surface 510 of the conditioning element 502 has abrasive conditioning elements disposed thereon that come into contact with the polishing pad 104 during processing. The abrasive conditioning elements may be any suitable abrasive conditioning element and may be attached to the conditioning element 502 as described in the embodiments detailed above.

Alternatively, the abrasive conditioning elements may be an integral part of and formed directly on the conditioning element 502. For example, raised teeth, ridges, grooves, and the like may be cut or otherwise formed into the conditioning element 502. The abrasive conditioning elements formed in this fashion may be fabricated in a pattern as required to provide the desired abrasive quality to the conditioning element 502.

The bottom surface 510 of the conditioning element 502 may further have a relieved edge 524, such as a radius, bevel, chamfer, and the like to assist in preventing the conditioning element 502 from rotating due to the relative motion between the pad conditioner 500 and the polishing pad 104. Alternatively or in combination, the bottom surface 510 of the conditioning element 502 may be slightly convex, curved, or bowed outward to further prevent an edge of the conditioning element 502 from digging into the polishing pad 104 when the conditioning element 502 is pressed against the polishing pad 104.

A support strip 504 may optionally be attached to the conditioning element 502. The support strip 504 may be attached by any suitable means, such as adhesives, bonding, screws, clamps, magnets, and the like. One or more pins (not shown) may optionally be disposed between the support strip 504 and the conditioning element 502 for additional support and stability. The support strip may be made of the same materials as the conditioning element 502. In an alternate embodiment, the conditioning element 502 may comprise a plurality of conditioning elements (not shown) attached to the support strip 504 and arranged to form the arc-shape of the polishing pad conditioner 500. Optionally, a plurality of grooves 520 (shown in phantom in FIG. 5A) may be formed in the bottom surface 510 of the conditioning element 502 to allow polishing fluid accumulated on the surface of the polishing pad 104 to flow through the polishing pad conditioner 500.

The housing 540 generally comprises a body 518 and a support 508. The body 518 houses an actuator 526 that is coupled to the support arm 118 via a shaft 528. Operation of the actuator 526 selectively raises and lowers the polishing pad conditioner 500 with respect to the polishing pad 104. As such, the polishing pad conditioner 500 may be positioned over the polishing pad by the support arm 118 and pressed against the polishing pad 104 by the actuator 526 when in use. A pair of guide rods 530 may extend into the body 518 from the support arm 118 for added stability.

Optionally, a bearing 522 may be disposed between the housing 540 and the support arm 118. The bearing 522 allows for the rotation of the polishing pad conditioner 500 to allow for a desired orientation of the pad conditioner with respect to the polishing pad 104. The orientation of the pad conditioner 500 may be controlled by a motor, for example, a servo motor, or an actuator (not shown). Alternatively, a spring (not shown) may be used to bias the pad conditioner towards a particular orientation. In addition, stop blocks (not shown) may be used to limit the range of motion and/or maintain the orientation of the pad conditioner 500.

The support 508 is attached to the body 518 by suitable fasteners or connectors, such as a plurality of screws 514. The conditioning element 502 and/or the optional support strip 504 is coupled to the support 508 by any suitable means, such as screws 516. One or more actuators 512 are disposed between the support 508 and the conditioning element 502 (three actuators 512 depicted in FIGS. 5A and 5B). The actuators 512 may selectively apply a controllable force between the support 508 and the conditioning element 502. The actuators 512 are utilized to control the downward force at particular locations along the length of the conditioning element 502 to more finely control the polishing profile. The actuators 512 are selected to have little or no friction to allow for ultra sensitive control of the downward conditioning force. The actuators 512 may be any suitable actuator such as voice coil actuators, pneumatic bellows, hydraulic actuators, and the like.

The actuators 512 may be used to control the conditioning profile of the polishing pad 104 in a variety of ways. In one embodiment, the conditioning element 502 may be rigid. As such, the relative force exerted by the actuators 512 forces the conditioning element 512 to rotate such that a central portion 560 of the conditioning element is lowered, remains substantially level with, or is raised with respect to outer portions 562. Alternatively or in combination, the conditioning element 502 may be somewhat flexible. A flexible conditioning element 502 allows for some rotation, or tipping, of the conditioning element 502, while allowing for localized deflection such that the conditioning element 502 becomes non-planar, or contoured to a desired shape or profile. The flexibility of the conditioning element 502 should be stiff enough to distribute the force applied by a particular actuator 512 to avoid undesirably gouging or deforming the polishing pad 104. In an alternate embodiment, where a flexible conditioning element is used, the conditioning element may be linear, rather than arc-shaped. The flexible linear conditioning element controls the conditioning profile formed in the polishing pad 104 through control of the contour of the bottom 510 of the conditioning element 502 by the actuators 512.

Figure 5C:
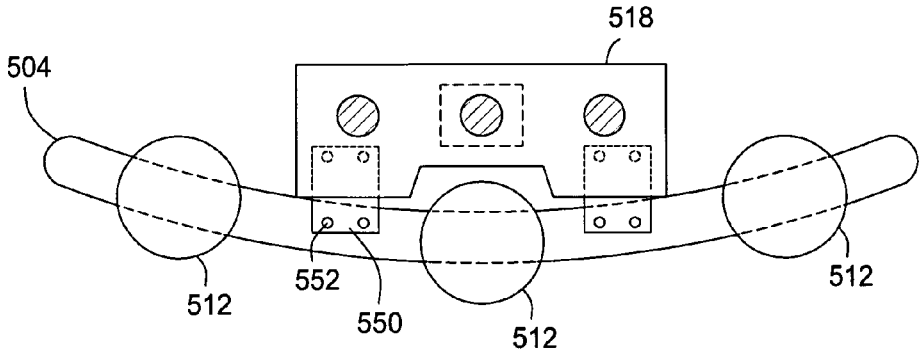
FIG. 5C is a top view of another embodiment of a pad conditioner.

A flexible coupling may optionally be attached between the conditioning element 502 and the housing 540. For example, as depicted in FIG. 5C, a horizontal flexure 550 may be coupled between the body 518 and the support strip 504. In the embodiment depicted in FIG. 5C, the support strip 508, not depicted for clarity, is coupled to the body 518 as described above. The horizontal flexure 550 is attached by any suitable means, such as screws 552. The horizontal flexure 550 absorbs the horizontal force and overturning moment that develops when the conditioner is pressed against a rotating pad. As such, the horizontal flexure 550 should be coupled as close to the bottom of the housing 540, or surface of the polishing pad as practical. The horizontal flexure 550 allows for vertical flexibility of the conditioner to allow the actuators 512 to independently control the conditioning profile during processing. The horizontal flexure 550 may comprise a thin, flat strip of stainless steel or other process appropriate material. It is contemplated that other flexible joints may be used in place of the horizontal flexure 550 to minimize the effect of the overturning moment, such as ball joints, rod ends, linkages, and the like.

Figure 6A:
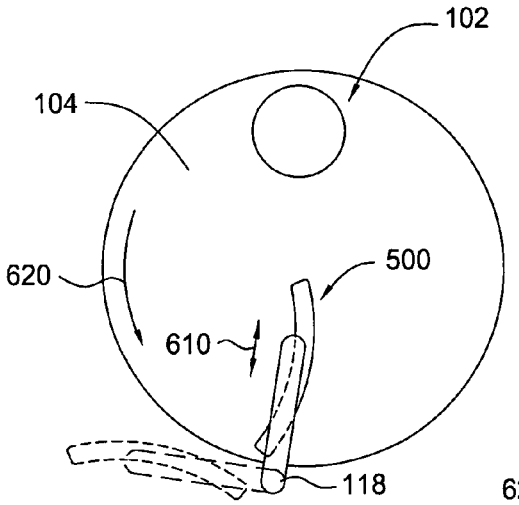
FIG. 6 is a plan view showing the configuration of the pad conditioner depicted in FIGS. 5A–B and a polishing head atop a polishing pad.
Figure 6B:
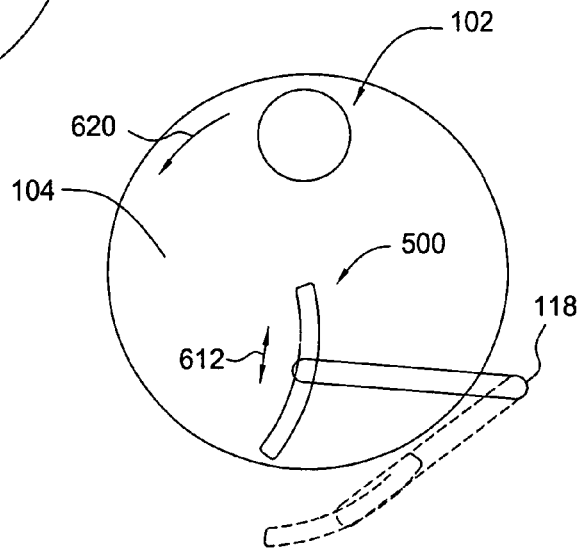
Figure 7A:
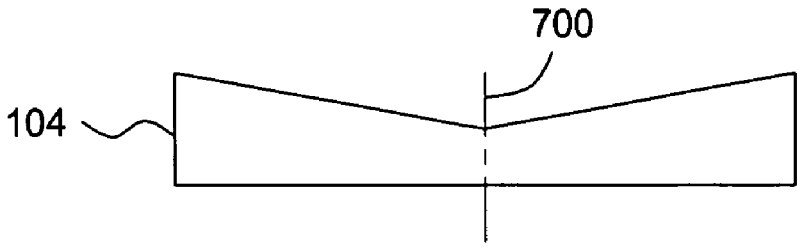
FIGS. 7A–7D respectively depict illustrative side views of polishing pads profiles attainable using the pad conditioner embodiment of FIGS. 5A–B taken along a diameter of the polishing pad.
Figure 7B:
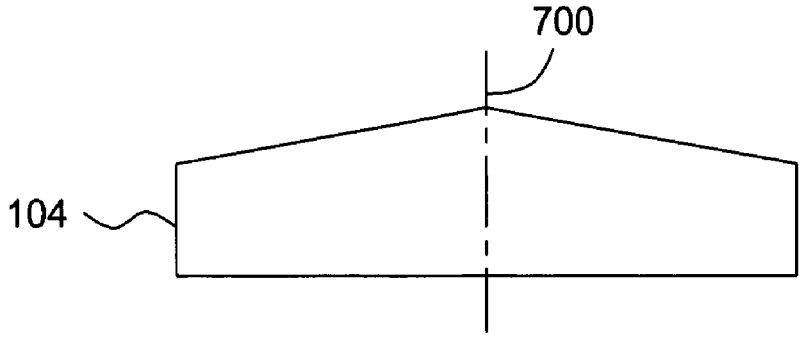
Figure 7C:
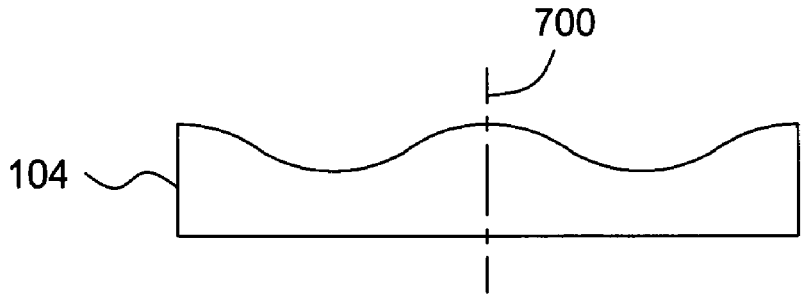
Figure 7D:
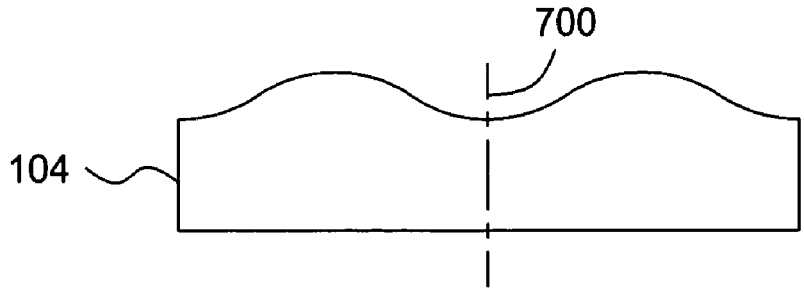

Illustrative top views of the polishing pad conditioner 500 are shown in FIGS. 6A and 6B. FIGS. 6A–B depict the position of the polishing pad conditioner 500 as supported by the support arm 118 over the polishing pad 104 and generally opposite the carrier head 102. In the embodiment depicted in FIG. 6A, the polishing pad conditioner 500 is held substantially parallel to the support arm 118, which reciprocates as indicated by arrows 610. In the embodiment depicted in FIG. 6B, the polishing pad conditioner 500 is held substantially perpendicular to the support arm 118, which oscillates as indicated by arrows 612.

In the embodiment depicted in FIGS. 6A–B, the polishing pad 104 is rotating in a counter clockwise direction as indicated by arrow 620. Although the polishing pad conditioner 500 is shown in FIGS. 6A–B with a concave face oriented towards the oncoming rotation of the polishing pad 104, such that it acts as a scoop or collection basin for polishing fluid, it is contemplated that the opposite orientation could be used in order to urge fluid off of the pad 104. Furthermore, although the polishing pad conditioner 500 is positioned radially with respect to the polishing pad 104 in FIGS. 6A–B, it is contemplated that other non-radial configurations may be used as well.

The polishing pad conditioner 500 is generally of sufficient size to condition the polishing pad 104 from the edge to the center of the polishing pad 104. As such, the width W of the polishing pad conditioner 500 (as shown in FIG. 5B) may be at least equal to the radius of the polishing pad 104 (or a polishing portion thereof. It is contemplated that a usable portion of the polishing pad may be conditioned rather then the entire polishing pad. This allows the polishing pad to be conditioned over its entire surface, or working surface, once each revolution of the polishing pad. This advantageously eliminates the "shadow" effect, or conditioning trail, resulting from smaller conditioners that condition only a portion of the polishing pad each revolution.

In addition, the polishing pad conditioner 500 may be radially oscillated. The radial oscillation of the polishing pad conditioner 500 advantageously smoothes any circumferential grooving that may otherwise develop by the static location of the conditioning elements on the polishing pad.

Furthermore, smaller conventional pad conditioners must vary the position of the conditioner over time in order to create a desired polishing pad profile. However, the polishing pad conditioner 500 advantageously provides a time independent pad conditioning force profile by controlling the pressure applied by the actuators 512 and the actuator 526.

Another benefit of the polishing pad conditioner 500 as described above is the ability to create a variety of pad conditioning profiles of revolution. FIGS. 7A–7D illustratively depict examples of four pad conditioning profiles of revolution about a center axis 700 of a polishing pad 104. For example, if the actuators 512 pressurized uniformly, the polishing pad 104 may be conditioned to be uniformly flat. If higher removal is desired in a center of the polishing pad 104, the pressure may be increased in the actuators 512 operating near the center of the polishing pad 104 as compared to the actuators 512 operating near the outer edge of the polishing pad 104. This may be used to provide a concave conical profile on the polishing pad 104, as depicted illustratively in FIG. 7A. Conversely, a higher removal rate on the outside of the polishing pad 104 may be attained by adjusting the pressure applied by the actuators 512 operating near the outside of the polishing pad 104 to be higher than the pressures operating near the center of the polishing pad 104 to form a convex conical profile, as depicted illustratively in FIG. 7B.

Alternatively, if higher removal is desired in a middle band of the polishing pad 104, the pressure may be increased in the actuators 512 operating near the center of the polishing pad conditioner 500 as compared to the actuators 512 operating near the outer edges of the polishing pad conditioner 500. This may be used to provide a trough-type toroidal profile on the polishing pad 104, as depicted illustratively in FIG. 7C. A lower removal rate in the middle band of the polishing pad 104 may be attained by adjusting the pressures applied by the actuators 512 positioned at the outer ends of the polishing pad conditioner 500 to be higher than the pressures operating near the center of the polishing pad conditioner 500 to create a hill-type toroidal profile, as depicted illustratively in FIG. 7D. Further combinations of actuator pressures could create a variety of pad profile shapes as desired.

Furthermore, the polishing pad conditioner 500 is suitable for conditioning polishing pads having a non-planar polishing surface profile prior to conditioning with the pad conditioner 500. For example, the surface of a polishing pad may be pre-conditioned or machined to form a desired contoured surface, e.g., a hill-type or trough-type toroidal surface as described above, or other desired surface profile. Alternatively, a flexible polishing pad may be shimmed or have a non-planar support placed beneath the polishing pad to contour the surface of the polishing pad as desired. In the aforementioned embodiments, the polishing pad conditioner 500 is controllable to contour the conditioning element 502 to contact the surface of the polishing pad as desired to condition the contoured polishing pad without altering the desired profile.

While the foregoing is directed to the illustrative embodiment of the present invention, other and further embodiments of the invention may be devised without departing from the basic scope thereof.

The invention claimed is:

1. An apparatus for conditioning a processing pad, comprising:

a flexible member having an arcuate shape;

an abrasive bottom surface formed on the member and configured for conditioning a processing pad; and a plurality of actuators configured to control a contour of the bottom surface of the member, further comprising one or more grooves formed along the bottom of the member and running from a front side of the member to a back side of the member.

* * * * *